US005216843A

United States Patent [19]

Breivogel et al.

[11] Patent Number: 5,216,843

[45] Date of Patent: Jun. 8, 1993

[54] POLISHING PAD CONDITIONING APPARATUS FOR WAFER PLANARIZATION PROCESS

[75] Inventors: Joseph R. Breivogel, Aloha; Loren R. Blanchard, Hillsboro; Matthew J. Prince, Portland, all of Oreg.

[73] Assignee: Intel Corporation, Santa Clara, Calif.

[21] Appl. No.: 950,812

[22] Filed: Sep. 24, 1992

[51] Int. Cl.[5] ..... B24B 29/00

[52] U.S. Cl. ..... 51/131.1; 51/131.3; 51/237 R; 51/317; 51/325; 51/263; 51/209 DL

[58] Field of Search ..... 51/129, 131.1, 131.3, 51/131.4, 131.5, 236, 237 R, 240 T, 317, 323, 324, 325, 292, 263, 5 D, 209 DL, 277

[56] References Cited

U.S. PATENT DOCUMENTS 2,826,009 3/1958 Shurson ..... 51/129

4,839,993 6/1989 Masuko et al. ..... 51/129

*Primary Examiner*—Bruce M. Kisliuk

*Assistant Examiner*—Eileen Morgan

*Attorney, Agent, or Firm*—Blakely, Sokoloff, Taylor & Zafman

[57] ABSTRACT

An improved apparatus for polishing a thin film formed on a semiconductor substrate includes a rotatable table covered with a polishing pad. The table and the pad are then rotated relative to the substrate which is pressed down against the pad surface during the polishing process. Means is provided for generating a plurality of grooves in the pad while substrates are being polished. The continually formed grooves help to facilitate the polishing process by channeling slurry between the substrate and the pad.

16 Claims, 4 Drawing Sheets

POLISHING PAD CONDITIONING APPARATUS FOR WAFER PLANARIZATION PROCESS

BACKGROUND OF THE INVENTION

1 Field of the Invention

The present invention relates to the field of semiconductor processing; and more specifically to the field of polishing methods and apparatuses for planarizing thin films formed over a semiconductor substrate.

2 Description of Related Art

Integrated circuits (IC's) manufactured today generally rely upon an elaborate system of metalization interconnects to couple the various devices which have been fabricated in the semiconductor substrate. The technology for forming these metalized interconnects is extremely sophisticated and well understood by practitioners in the art.

Commonly, aluminium or some other metal is deposited and then patterned to form interconnect paths along the surface of the silicon substrate. In most processes, a dielectric or insulated layer is then deposited over this first metal (metal 1) layer; via openings are etched through the dielectric layer and the second metalization layer is deposited. The second metal layer covers the dielectric layer and fills the via openings, thereby making electrical contact down to the metal 1 layer. The purpose of the dielectric layer, of course, is to act as an insulator between the metal 1 and metal 2 interconnects. Most often the intermetal dielectric layer comprises a chemical vapor deposition (CVD) of silicon dioxide which is normally formed to a thickness of approximately one micron. (Conventionally the underlying metal 1 interconnects are also formed to a thickness of approximately one micron.) This silicon dioxide layer covers the metal 1 interconnects conformably such that the upper surface of the silicon dioxide layer is characterized by a series of nonplanar steps which correspond in height and width to the underlying metal 1 lines.

These step height variations in the upper surface of the interlayer dielectric have several undesirable features. First of all, nonplaner dielectric surfaces interfere with optical resolution of subsequent photolithographic processing steps. This makes it extremely difficult to print high resolution lines. A second problem involves the step coverage of metal 2 (second metal) layer over the interlayer dielectric. If the step height is too large there is a serious danger that open circuits will be formed in metal 2 layer.

To combat these problems, various techniques have been developed in an attempt to planarize the upper surface of the interlayer dielectric (ILD). One approach employs abrasive polishing to remove the protruding steps along the upper surface of the dielectric. According to this method, the silicon substrate is placed face down on a table covered with a flat pad which has been coated with an abrasive material (slurry). Both the wafer and the table are then rotated relative to each other to remove the protruding portions. This abrasive polishing process continues until the upper surface of the dielectric layer is largely flattened.

One factor in achieving and maintaining a high and stable polishing rate is pad conditioning. Pad conditioning is a technique whereby the pad surface is put into a proper state for subsequent polishing work. In one conditioning method, as shown in FIG. 1, the polishing pad 12 is impregnated with a plurality of macrogrooves 14.

Polishing pad 12 is shown in FIG. 1 having a series of substantially circumferential grooves 14 formed across the portion of the pad over which polishing takes place. The macrogrooves aid in polishing by channeling slurry between the substrate surface and the pad. The macrogrooves 14 are formed prior to polishing by means of a milling machine, a lathe, a press or similar method. Since polishing does not normally occur across the entire pad surface, the grooves are normally only formed into a portion of the pad over which polishing takes place. This is shown in FIG. 1 by the grove path area 16.

FIG. 2 illustrates a cross section of grooved path area 16 formed on the pad 12. As can be seen, the grooves are characteristically triangular shaped (but may have other shapes as well), and have an initial depth which is sufficient to allow slurry to channel beneath the substrate surface during polishing. The depth of the macrogrooves is approximately 300 microns. The spacing of the grooves varies from about two grooves per radial inch to 32 grooves per radial inch.

A problem with this technique of conditioning the pad is that over time, the one time provided macrogrooves become worn down due to polishing. This is shown by the broken line 18 in FIG. 1. As polishing occurs, pad 11 gets worn away and the added macrogrooves become smoothed over. A smooth pad surface results in a reduction of slurry delivery beneath the wafer. The degradation in pad roughness over time results in low, unstable, and unpredictable polish rates. Low polish rates decrease wafer throughput. Unstable and unpredictable polish rates make the planarization process unmanufacturable since one can only estimate the amount of ILD removed from wafer to wafer. Additionally, when the pad roughness becomes "glazed" or "smoothed" over time, rough wafers polish at a different, higher rate than do smooth wafers. That is, wafers which have rough surfaces from, for example, laser scribe lines, polish at faster rates because their surfaces "rough" the pad surface while they polish. This increases slurry delivery beneath these wafers which accounts for the rise in polish rate. Thus, the polish rate of wafers polished with the earlier method is dependant upon wafer type. Different polish rates for different types of wafers make the polishing process unmanufacturable.

Thus, what is desired is an apparatus and method for mechanically polishing a thin film wherein the polish rate is high, stable, and independent of wafer type.

SUMMARY OF THE INVENTION

An apparatus for polishing a thin film formed on a semiconductor substrate is described. The apparatus has a rotatable table and a means for rotating the table. A polishing pad with a plurality of preformed, circumferential, triangular grooves of about 300 microns deep covers the table. The preformed grooves facilitate the polishing process by creating a corresponding plurality of point contacts at the pad/substrate surface. Means is provided for depositing an abrasive slurry on the upper surface of the pad. Means is also provided for forcibly pressing the substrate against the pad such that the rotational movement of the table relative to the substrate together with the slurry results in planarization of the thin film. Additionally, while wafers are polished a pad conditioning apparatus generates a plurality of radial microchannel grooves with a triangular shape and with a depth of about 40 microns. The microchannel grooves aid in facilitating polishing by channeling slurry between the substrate and the polishing pad. The pad conditioning apparatus comprises a diamond block holder having a plurality of threaded diamond tipped shanks embedded into a substantially planar surface of the block. A conditioner arm is coupled at one end to the diamond block holder and at the other end to a variable speed oscillating motor. The motor pivots the arm about a fixed point which sweeps the holder block in a radial direction across a predetermined portion of the polishing pad. The embedded diamond tipped threaded shanks generate the microchannel grooves as the holder block is swept across the pad surface.

A goal of the present invention is to provide an apparatus for planarizing a thin film by polishing, wherein the polish rate is high, stable, and wafer independent.

Another goal of the present invention is to continually and consistently channel slurry between the polishing pad and substrate by continually conditioning the pad surface during polishing.

Still another goal of the present invention is to provide means to adequately and continually condition the polishing pad without providing undo wear on the pad surface.

Still yet another goal of the present invention is to be able to condition predetermined portions of the polishing pad more than other portions of the pad.

BRIEF DESCRIPTION OF THE DRAWINGS

FIG. 2 also shows the "smoothing" of the preformed macrogrooves due to polishing.

FIG. 5(*b*) is a bottom view of the diamond block holder of the pad conditioning assembly of the present invention.

FIG. 5(*c*) is an illustration of the threaded diamond tipped stainless steel shank used in the pad conditioning assembly of the present invention.

DETAILED DESCRIPTION OF THE PRESENT INVENTION

An improved polishing apparatus utilized in the polishing of a thin film formed on a semiconductor substrate is described. In the following description numerous specific details are set forth, such as specific equipment and material, etc. in order to provide a thorough understanding of the invention. It will be obvious, however, to one skilled in the art, that the present invention may be practiced without these specific details. In other instances, other well known machines and processing steps have not been described in particular detail in order to avoid unnecessarily obscuring the present invention.

Figure 1:
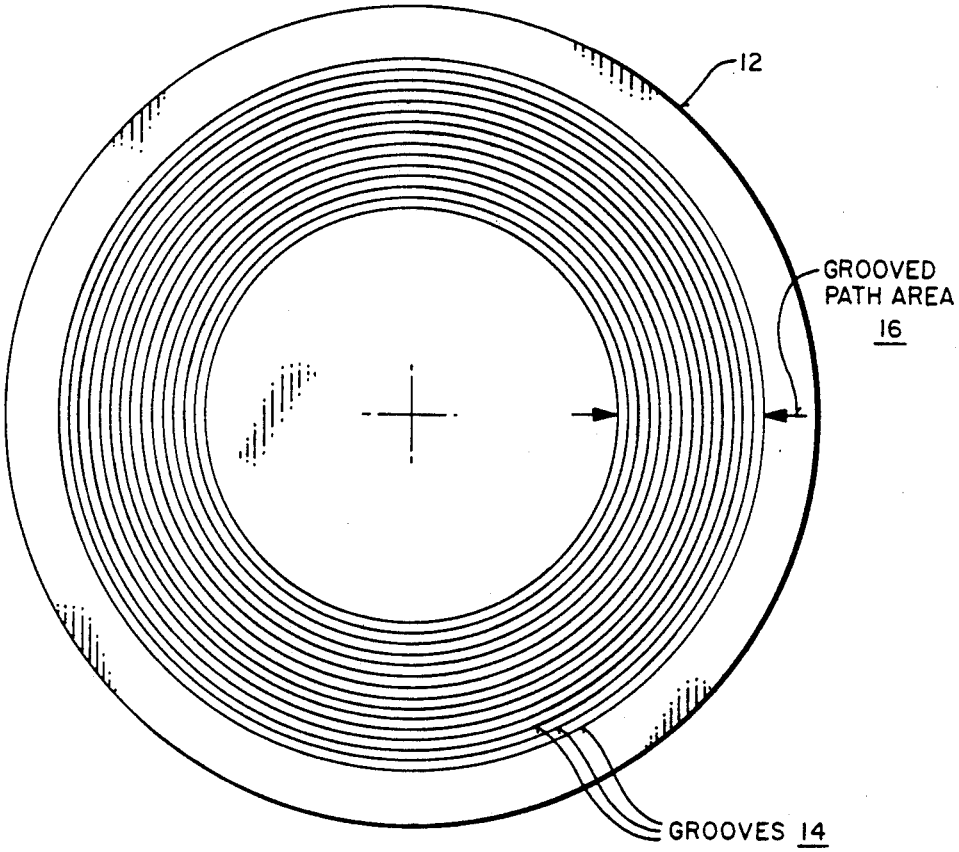
FIG. 1 is an overhead view of a polishing pad which has been preconditioned with macrogrooves.
Figure 2:
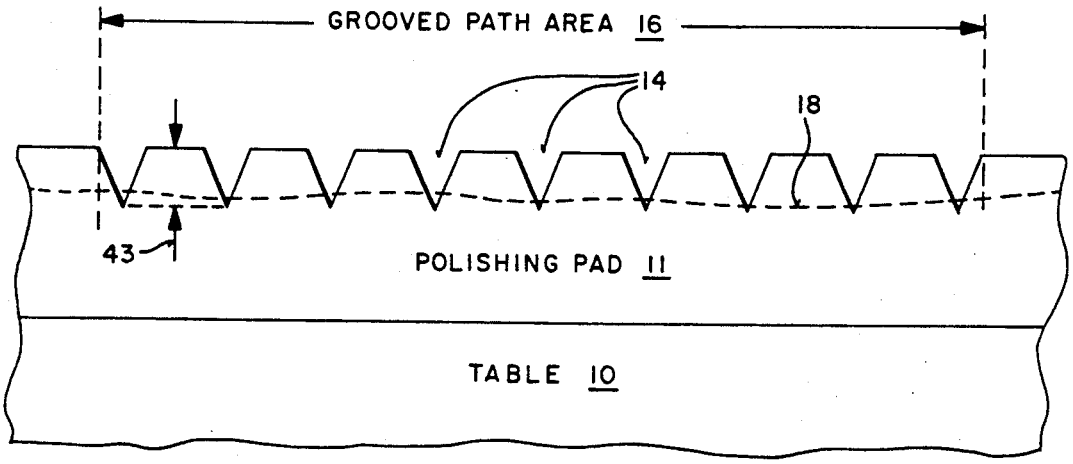
FIG. 2 is a cross-sectional view of a polishing pad which has been preconditioned with macrogrooves.
Figure 3:
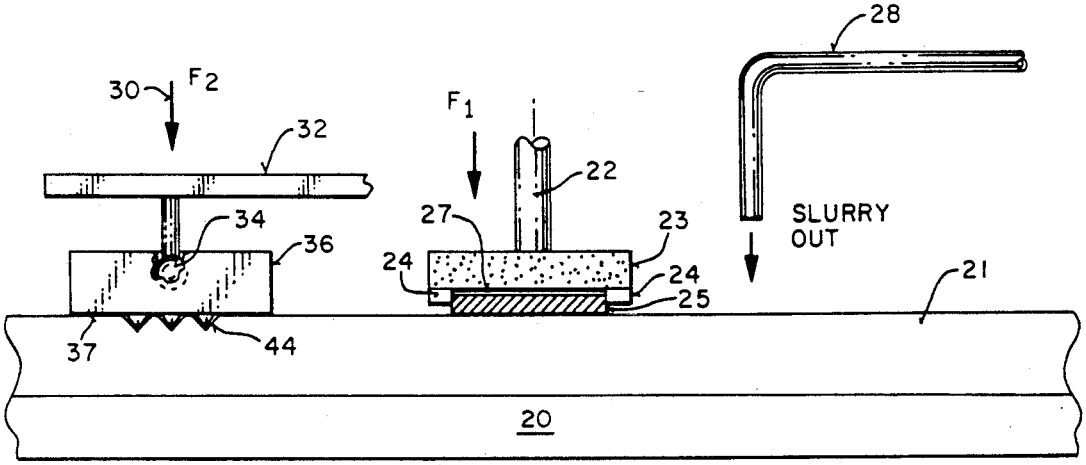
FIG. 3 is a side view of the wafer polishing apparatus of the present invention.

With reference to FIG. 3, the polishing apparatus of the present invention is illustrated. The polishing apparatus is used to planarize a thin film layer formed over a semiconductor substrate. The thin film is typically an interlayer dielectric (ILD) formed between two metal layers of a semiconductor device. The thin film, however, need not necessarily be an ILD, but can be any one of a number of thin films used in semiconductor circuit manufacturing such as, but not limited to: metal layers, organic layers, and even the semiconductor material itself. In fact, the pad conditioning technique of the present invention can be generally applied to any polishing process which uses similar equipment and where polishing pad "smoothing" causes the polish rate to decline. For example, the present invention may be useful in the manufacture of metal blocks, plastics, and glass plates.

During planarization, a silicon substrate 25 is placed face down on pad 21 which is fixedly attached to the upper surface of table 20. In this manner, the thin film to be polished is placed in direct contact with the upper surface of the pad 21. According to the present invention, pad 21 comprises a relatively hard polyurethane, or similar material, capable of transporting abrasive particulate matter such as silica particles. In the currently preferred embodiment of the present invention, an initially nonperforated pad manufactured by Rodel, Inc. known by the name "IC60" is employed. It is appreciated that similar pads having similar characteristics may also be used in accordance with the invented method.

Carrier 23, also know as a "quill", is used to apply a downward pressure F1 against the backside of the substrate 25. The backside of substrate 25 is held in contact with the bottom of carrier 23 by a vacuum or simply by wet surface tension. Preferably, an insert pad 27 cushions wafer 25 from carrier 23. An ordinary retaining ring is employed to prevent wafer 25 from slipping laterally from beneath carrier 23 during processing. The applied pressure F1 is typically on the order of 5 lbs per square inch and is applied by means of a shaft 22 attached to the back side of carrier 23. This pressure is used to facilitate the abrasive polishing of the upper surface of the thin film. Shaft 22 may also rotate to impart rotational movement to substrate 25. This greatly enhances the polishing process.

Additionally, a pad conditioning assembly 30 is provided for generating microchannels 50 in pad 21. The microchannels 50 are generated while wafers are being planarized. The pad conditioner assembly 30 comprises a conditioner arm 32 wherein one end of arm 32 is coupled by means of a ball and socket joint 34 to a diamond holder block 36. The ball and socket joint 34 helps to ensure that the bottom surface 37 of holder block 36 is uniformly in contact with pad 21 when undulations in pad 21 are present. In the preferred embodiment the diamond holder block 36 has five threaded stainless steel diamond tipped shanks 38 embedded into the bottom surface 37 of holder block 36. The diamond tips 44 of shanks 38 protrude a distance of 40 microns from the bottom plane 37 of the holder. The weight of the conditioning assembly 30 provides a downward force F2 of approximately 16 ounces. Such a force is adequate to embed the diamond tips 44 of the stainless steel shanks 38 into pad 21. The bottom surface 37 of the diamond holder block 36 acts as a mechanical stop to ensure that the diamond tips 44 are embedded into 21 pad at the preferred depth of 40 microns.

Figure 4:
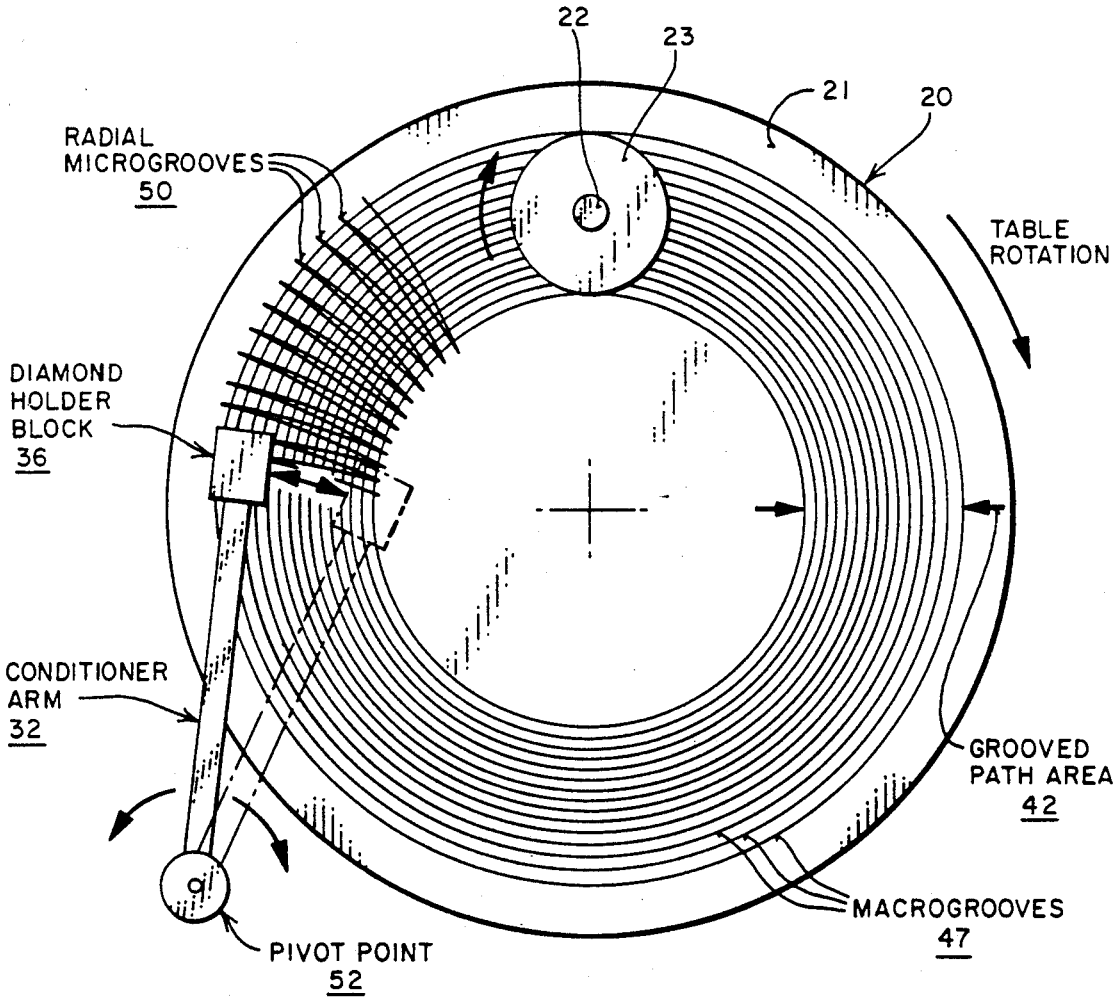
FIG. 4 is an overhead view of the wafer polishing apparatus of the present invention.

FIG. 4 is an overhead view of the polishing apparatus of the present invention. In the preferred embodiment of the present invention the polishing pad 21 is initially conditioned prior to polishing by impregnating the surface with a plurality of circumferential macrogrooves 47. It is to be appreciated that macrogrooves other than circumferential macrogrooves can be utilized. The one-time provided macrogrooves are formed be means of a milling machine, lathe, or press, or similar method. There are between 2-32 macrogrooves per radial inch. The macrogrooves are dimensioned so as to facilitate the polishing processing by creating point contact at the pad/substrate interface. The grooves also increase the available pad area and allow more slurry to be applied to the substrate per unit area. Although the preferred embodiment of the present invention preconditions pad 21 with macrogrooves prior to polishing, one need not necessarily precondition pad 21. That is, a smooth pad 21 can be utilized in the present invention because the pad conditioning apparatus 30 of the present invention adequately conditions the pad surface during the planarization process.

During polishing operations, carrier 23 typically rotates at approximately 40 rpms in a circular motion relative to table 20. This rotational motion is easily provided by coupling an ordinary motor to shaft 22. In the currently preferred embodiment, table 20 also rotates at approximately 15 rpms in the same direction relative to the movement of the substrate. Again, the rotation of table 20 is achieved by well-known mechanical means. As table 20 and carrier 23 are rotated, a silica based solution (frequently referred to as "slurry") is dispensed or pumped through pipe 28 onto the upper surface of pad 21. Currently, a slurry known as SC3010, which is manufactured by Cabot Inc. is utilized. In the polishing process the slurry particles become embedded in the upper surface of pad 21. The relative rotational movements of carrier 23 and table 20 then facilitates the polishing of the thin film. Abrasive polishing continues in this manner until a highly planar upper surface is produced and the desired thickness reached.

Figure 5A:
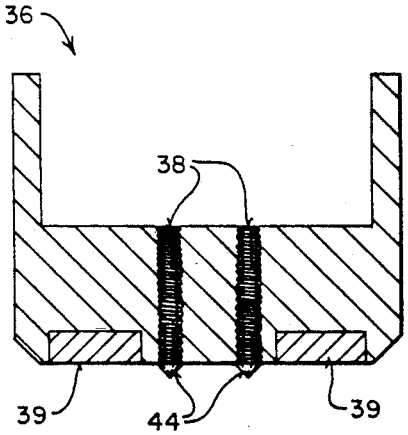
FIG. 5(*a*) is a cross-sectional view of the diamond block holder of the pad conditioning assembly of the present invention.

FIG. 5*a* is a cross sectional view of diamond holder block 36 of the pad conditioner apparatus 30. The diamond block holder 36 is made of stainless steel. The block holder 36 has a substantially planar bottom surface 37. The bottom surface 37 has two silicon carbide wear plates 39 recessed within holder 36 and flush with bottom surface 37. The silicon carbide wear plates 39 prevent diamond holder block 36 from becoming worn out during continuous polishing. Embedded within holder 36 are a plurality of stainless steel threaded shanks 38. The tops of the threaded shanks 38 are accessible at top surface 42 of the holder 36. In this way the length at which diamond tips 44 of the threaded shanks 38 protrude from surface 37 can be easily controlled. In the preferred embodiment of the present invention the diamond tips 44 protrude about 40 microns from surface 37.

Figure 5B:
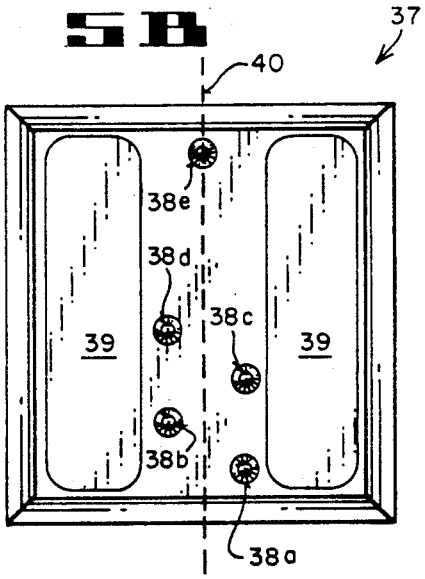

FIG. 5*b* is a view of the bottom surface 37 of the holder 36. Five diamond tipped threaded shanks are shown arranged in the preferred pattern. Four of the five shanks 38*a*, 38*b*, 38*c*, and 38*d* are arranged in a parallelogram configuration around a center axis 40 of bottom surface 37. The shanks 38*a*, 38*b*, 38*c*, and 38*d* are separated from one another by a distance of approximately 0.15 inches. The fifth shank 38*e* is placed on the center axis 40 about an inch from shank 38*d*. Although the exact number and placing of the shanks need not be as shown, and in fact can be quite arbitrary, the present number and placing works well in providing adequate spacing and arrangement of microchannels 50 in pad 21. The microchannels 50 provided by such arrangement and number provide adequate roughing of pad 21 in order to continually channel slurry beneath the wafer without providing undue wear on pad 21.

Figure 5C:
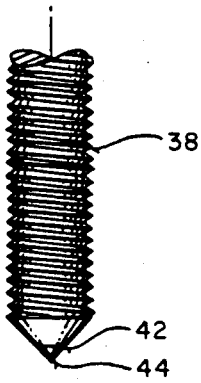

FIG. 5*c* is a detail of the diamond tipped stainless steel threaded shank 38 used in the present invention. The shank 38 in the preferred embodiment is approximately 0.4 inches long and has a diameter of about ⅛ inch. The shank is made of stainless steel. The shank 40 has a cone shaped base 42 of about 0.05 inches. A grade A or AA diamond tip 44 without cracks or major flaws is welded onto base 42 of shank 38. The point of diamond tip 44 is ground to a 90° angle. The shank 38 is threaded so that the length at which shank 38 protrudes from holder 36 may be variably controlled and so that shank 38 can be securely fastened within holder 36. The diamond tipped threaded shank 38 of the present invention is manufactured by makers of diamond tools with well know techniques.

Referring back to FIG. 4, in order to polish wafers and thereby smooth the thin film layer, table 20 and pad 21 rotate in a clockwise direction as does quill 23. As wafers are polished the conditioning assembly 30 oscillates so that diamond holder block 36 sweeps back and forth across the previously provided macrogrooves 47 with a fixed downward pressure. The diamond tips 44 of the shanks 38 located in holder 36 generate microchannel grooves 50 into pad 21 and thereby condition pad 21 for maximum slurry transport. In the preferred embodiment the microgrooves 50 are radial in direction and extend the entire distance across the macrochannelled grooved path area 42. The diamond holder block makes approximately 3.5 cycles (sweeps back and forth) per revolution of pad 21. The rate is chosen to adequately condition pad 21 for optimal slurry transport but yet not to overly degrade pad 21. Additionally, a fractional number of cycles is chosen so that diamond holder block 36 does not continually condition the same area of pad 21 time after time. In this way, over time the entire grooved path area 42 is uniformly conditioned with microchannels.

The holder 36 is swept across pad 21 by means of an oscillating motor coupled to conditioner arm 32 at pivot point 52. The motor in the preferred embodiment is a variable-speed oscillating motor. A variable-speed motor allows holder 36 to move across different radii of pad 21 at different rates. This allows holder 36 to spend more time at certain radii of pad 21 than at other radii, thereby conditioning specific radii of pad 21 more than other radii. This is useful when pad 21 wears at specific radii more than at other radii. In this way pad conditioner assembly 30 can spend more time conditioning those areas of pad 21 which become worn down or smoothed quicker that other areas of pad 21. The variable speed motor also allows pad conditioner assembly 30 to operate synchronously with different table 20 rotation rates.

Figure 6:
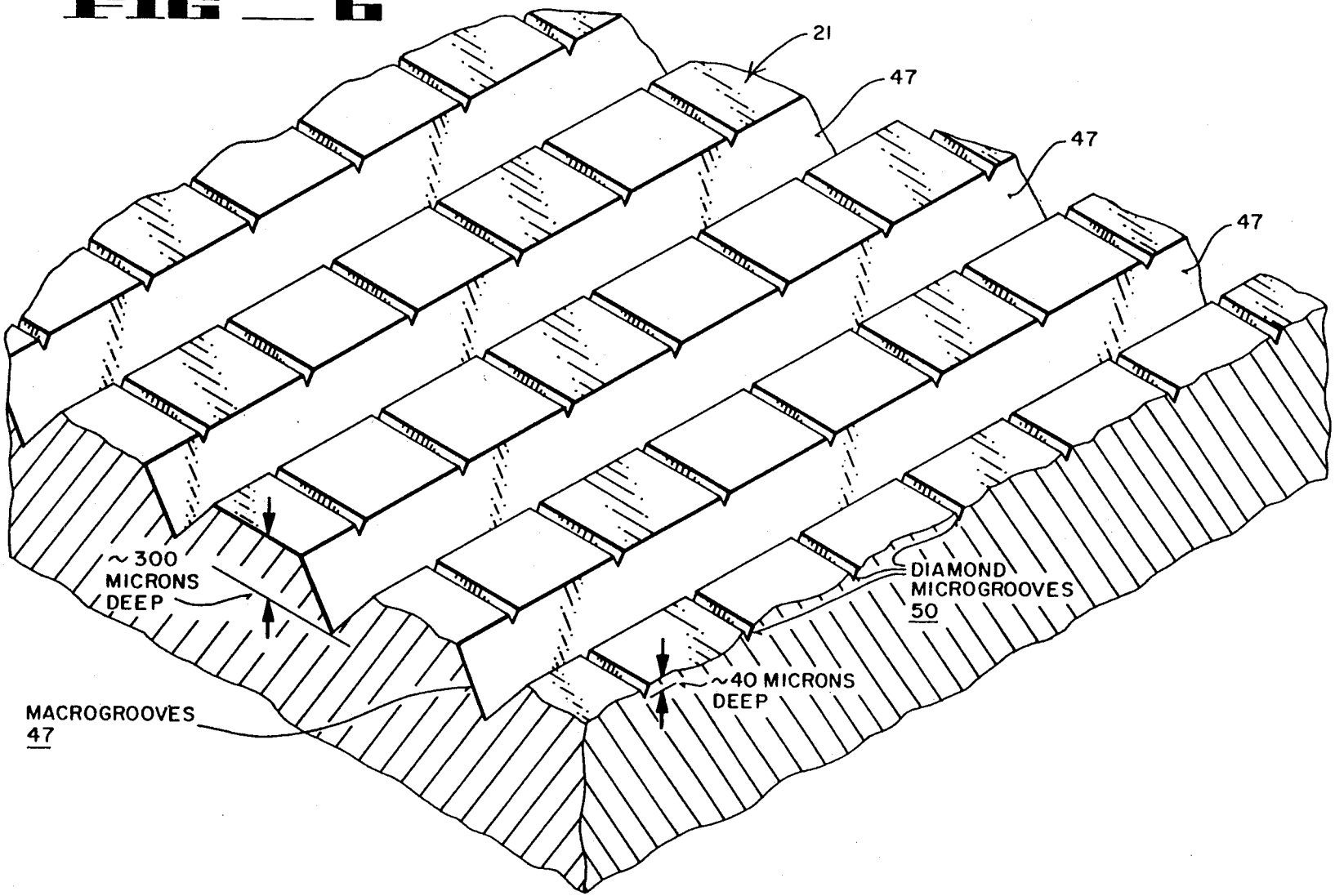
FIG. 6 is a cross-sectional view of a polishing pad showing preformed macrogrooves and the pad conditioning assembly generated microgrooves.

FIG. 6 is a cross-sectional view of pad 21. The one time provided preformed macrogrooves 47 are shown having a triangular shape and a depth of approximately 300 microns. It is to be appreciated that although the macrogrooves 47 characteristically have a triangular cross-sectional shape, other shapes such as U's and sawtoothed can be used as well. The microgrooves 50 generated by the diamond tips 44 of shanks 38 during wafer planarization are shown having a triangular shape with a depth of about 40 microns and a spacing of approximately 0.15 inches. Although the microgrooves 50 are generated radially in the preferred embodiment, it is to be appreciated that other directions may also be used. The radial direction of microgrooves 50 is preferred because it aids in the delivery of slurry into the preformed macrogrooves 47. What is most important, however, is to continually form microgrooves 50 which adequately and continually condition pad 21 during wafer planarization so that slurry can be readily and continually supplied between the wafer being planarized and pad 21.

The pad conditioner assembly 30 continually conditions pad 21 with microgrooves 50 as wafers are being planarized. The continual generation of microgrooves 50 increases and stabilizes the wafer polishing rate. In the present invention a dielectric layer of a wafer is removed at a rate of approximately 2,500 Å per minute. It is to be appreciated that this is a fast rate allowing for good wafer throughput. More importantly, with the apparatus of the present invention the polish rate remains stable from wafer to wafer, making the present invention much more manufacturable than earlier techniques. Because pad 21 is continually conditioned with microchannel grooves 50, a continual and consistent flow of slurry is delivered between the wafer being planarized and pad 21. In the earlier method, the one time generated macrogrooves 47 become "smooth" or "glazed" over time, resulting in a decrease in slurry delivery over time which causes a slow and unstable polishing rate. Additionally, in the present invention the polish rate is not dependant upon the type of wafers being polished. That is, wafers with rough surfaces (i.e. with bumpy surfaces or with laser scribe marks) have substantially the same polish rates as do smooth wafers. This is because in the present invention all wafers receive substantially the same amount of slurry delivery due to the continual conditioning of pad 21 by the pad conditioning assembly 30. The polishing rate of the polishing apparatus of the present invention is essentially wafer independent, making the polishing apparatus of the present invention much more reliable and manufacturable than previous designs.

Thus, an apparatus and method for planarizing a thin film of a semiconductor device has been described. The apparatus continually generates microgrooves into a polishing pad surface while wafers are polished. The generated microgrooves provide a consistent supply of slurry between wafers and the polishing pad, resulting in a high, stable, and wafer independent polish rate.

We claim:

1. An apparatus for polishing a thin film formed on a semiconductor substrate, said apparatus comprising:

rotatable table;

means for rotating said table;

a pad covering said table, said pad having an upper surface into which have been formed a plurality of preformed grooves, said preformed grooves facilitating the polishing process by creating a corresponding plurality of point contacts at the pad/substrate interface;

means for depositing an abrasive slurry on said upper surface of said pad;

means for forcibly pressing said substrate against said pad such that rotational movement of said table relative to said substrate together with said slurry results in planarization of said thin film; and means for providing a plurality of microchannel grooves into said upper surface of said pad while polishing said substrate wherein said microchannel grooves aid in facilitating said polishing process by channeling said slurry between said substrate and said pad.

2. The apparatus of claim 1 wherein said plurality of preformed grooves are substantially circumferential grooves.

3. The apparatus of claim 1 wherein said plurality of microchannel grooves are substantially radial grooves.

4. The apparatus of claim 1 wherein said plurality of preformed grooves are circumferential grooves, and wherein said plurality of said microchannel grooves are radial grooves.

5. The apparatus of claim 4 wherein there are approximately 2–32 of said preformed grooves per radial inch in said surface of said pad.

6. The apparatus of claim 4 wherein said plurality of microchannel grooves are approximately 40 microns deep.

7. The apparatus of claim 4 wherein said microchannel providing means comprises:

a diamond holder block having a plurality of threaded diamond-tipped shanks embedded into a substantially planar bottom surface of said block such that said diamond tips protrude from said surface of said block;

a conditioner arm having one end coupled to said block and the other end coupled to means for pivoting said conditioner arm about a pivot point such that said diamond holder block sweeps in a radial direction across a predetermined portion of said pad.

8. The apparatus of claim 7 wherein said microchannel providing means sweeps across said predetermined portion of said pad at a rate of approximately seven times per revolution of said pad.

9. The apparatus of claim 7 wherein said conditioner arm is coupled to said diamond holder block by a ball and socket joint.

10. The apparatus of claim 7 wherein said means for pivoting said conditioner arm is a variable speed osillating motor.

11. In a semiconductor substrate polishing apparatus of the type which includes a rotatable table covered with a pad onto which is deposited an abrasive slurry, a means for rotating said table and a means for pressing said substrate against the surface of said pad such that the rotational movement of said table relative to said substrate in the presence of said slurry results in planarization of a thin film formed on said semiconductor substrate, an improvement for increasing and stabilizing the polishing rate which comprises:

means for generating a plurality of grooves in said pad while polishing said substrate wherein said grooves aid in facilitating said polishing process by channeling slurry between said substrate and said pad.

12. The improvement of claim 11 wherein a plurality of substantially circumferential grooves are formed in said pad prior to polishing.

13. The improvement of claim 12 wherein said means for providing a plurality of grooves during polishing produces grooves which are substantially radial in direction.

14. The improvement of claim 13 wherein said preformed substantially circumferential grooves are approximately 6–10 times deeper than said radial grooves formed by said groove generating means.

15. The improvement of claim 13 wherein said radial grooves and said circumferential grooves have triangular cross-sectional shapes.

16. An apparatus for polishing a surface of a material, said apparatus comprising:

rotatable table;

means for rotating said table;

a pad covering said table, said pad having an upper surface into which have been formed a plurality of preformed grooves, said preformed grooves facilitating the polishing process by creating a corresponding plurality of point contacts at the pad/-material interface;

means for depositing an abrasive slurry on said upper surface of said pad;

means for forcibly pressing said material against said pad such that rotational movement of said table relative to said material together with said slurry results in planarization of said material; and means for providing a plurality of microchannel grooves into said upper surface of said pad while polishing said material wherein said microchannel grooves aid in facilitating said polishing process by channeling said slurry between material and said pad.

* * * * *